United States Patent [19]

Tezuka

[11] 4,027,119

[45] May 31, 1977

[54] MULTI-DIRECTIONAL SWITCHING MECHANISM FOR CONTROLLING PLURAL LOAD CIRCUITS

[75] Inventor: Kiyoshi Tezuka, Shimizu, Japan

[73] Assignee: Murakami Kaimeido Co., Ltd., Japan

[22] Filed: Mar. 4, 1976

[21] Appl. No.: 663,592

[52] U.S. Cl. ..... 200/6 A; 200/1 R; 200/277

[51] Int. Cl.[2] ..... H01H 9/00; H01H 25/04

[58] Field of Search ..... 200/6 R, 6 A, 5 R, 1 R, 200/277

[56] References Cited

UNITED STATES PATENTS

| | | | |
|---|---|---|---|
| 1,995,708 | 3/1935 | Fischer | 200/11 R X |
| 3,238,316 | 3/1966 | Voss | 200/6 A |
| 3,337,698 | 8/1967 | Purcell, Jr. | 200/6 R |
| 3,679,847 | 7/1972 | House | 200/6 A |
| 3,927,285 | 12/1975 | Frost et al. | 200/6 A |
| 3,984,808 | 10/1976 | Laz et al. | 200/277 X |

*Primary Examiner*—James R. Scott
*Attorney, Agent, or Firm*—Beveridge, DeGrandi, Kline & Lunsford

[57] ABSTRACT

A driving power source and one or more load circuits are arranged in prescribed terminal contact with a revolving ball comprised of a pair of electro-conductive hemispheres and an intervening electro-insulating portion in such an arrangement that activation of each of the load circuits is switched on and off, polarity of the activation being controlled as desired by manual turning of the ball in selected directions and each hemisphere being always charged differently from the other through the terminal contact with the driving power source circuit.

13 Claims, 12 Drawing Figures

MULTI-DIRECTIONAL SWITCHING MECHANISM FOR CONTROLLING PLURAL LOAD CIRCUITS

BACKGROUND OF THE INVENTION

The present invention relates to a multi-directional switching mechanism, more particularly relates to a mechanism for switching on and off activation of one or more load circuits with free choice in the polarity using a ball manually turnable about its center as the major switching element.

In such a machine or mechanical equipment as a crane, a search-light a work machine, it is usually necessary that two or more loads, e.g. driving motors, should be concurrently operated in operational relationship to each other. In order to practice this control, a plurality of switching elements are conventionally used in combination with each other and a single lever or knob is used in order to operate the switching elements simultaneously. In the control of the above-described sense, it is often required that two or more sets of load circuits should be activated with desired combination of polarities of the circuit activation. Thus, the more complicated is the combination of the circuit activation polarities, the more complicated are the construction of the switching unit and operation thereof. Such complexities in the operation and construction of the conventional switching unit should further be amplified by the fact that, in practice, it is in general often required to change the mode of the circuit activation polarities in accordance with the disposition in which the machine is used. That is, provided that a load circuit is provided with an A-terminal and a B-terminal, it will be required under a situation that the circuit should be so biased that the electric current flows from the A-terminal to the B-terminal whereas it will be required under another situation that the circuit should be so biased that the electric current flows from the B-terminal to the A-terminal.

It is therefore the principal object of the present invention to provide a very compact switching mechanism of a very simplified construction which is capable of switching on and off activation of one or more load circuits with freedom in combination of circuit activation plarities via simple manual operation applied on an operating handle.

In accordance with the basic concept of the present invention, a housing defines an internal cavity accommodating a revolving ball which is comprised of a pair of electro-conductive hemispheres and an electro-insulating portion intervening the hemispheres. Each of a pair of terminals of a driving power source circuit is in a constant contact with each of the pair of hemispheres and the ball is associated with at least one load circuit a pair of terminals of which are in contact with the outer surface of the ball at points symmetric to each other with respect to the center of the ball. In the neutral disposition, the terminals of the load circuit are in contact with the electro-insulating portion of the ball and the load circuit is not activated. As the ball is manually turned about 45° about the center thereof, the different terminals of the load circuit come in contact with the different hemispheres of the ball which are differently charged and biased by the driving power source circuit and the load circuit is activated. When the ball is turned about 45° into the opposite direction, the load circuit is activated also but with different polarity.

BRIEF DESCRIPTION OF THE DRAWINGS

Further features and advantages of the present invention will be made clearer from the following description, reference being made to the accompanying drawings, in which.

DESCRIPTION OF THE PREFERRED EMBODIMENTS

Figure 1:
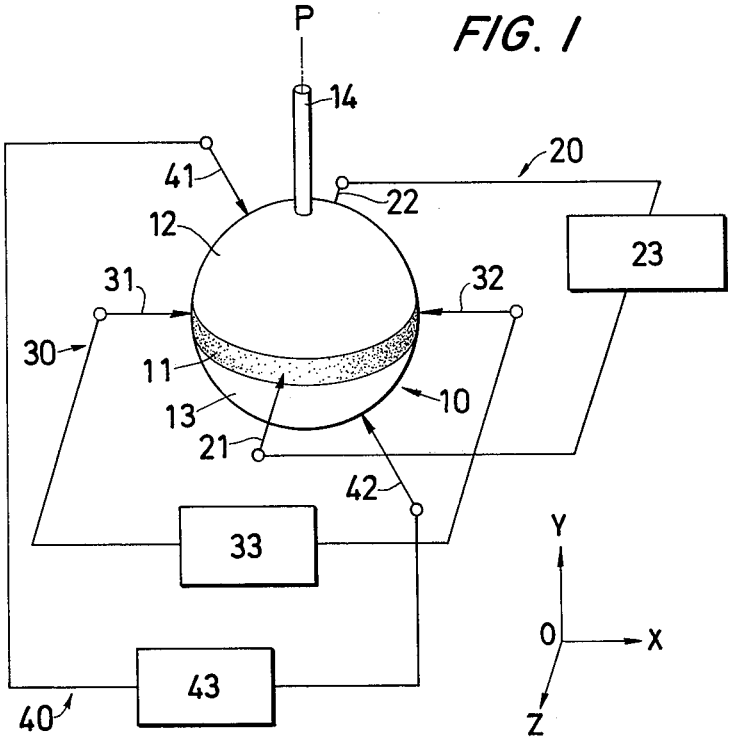
FIG. 1 is a perspective plan view for showing the principle construction of the switching mechanism in accordance with the present invention.

The principle construction of the multi-directional switching mechanism in accordance with the present invention is shown in FIG. 1, in which the main part of the switching mechanism is comprised of a revolving ball 10 and three sets of electric circuits 20, 30 and 40 accompanying the revolving ball 10.

The revolving ball 10 includes a pair of electro-conductive halves 12 and 13, an intermediate electric insulator 11 sandwiched by the halves 12 and 13 and an operating handle 14 fixed to the surface of one of the halves 12 and 13.

Figure 2:
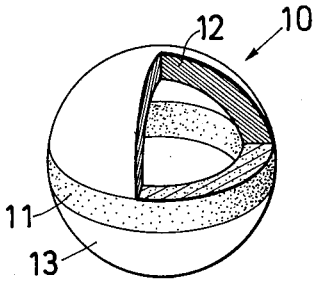
FIGS. 2 and 3 are perspective plan views of two different embodiments of the revolving ball to be used in the switching mechanism shown in FIG. 1, FIGS. 4 through 9 are perspective plan views for showing the switching operation of the switching mechanism shown in FIG. 1.
Figure 3:
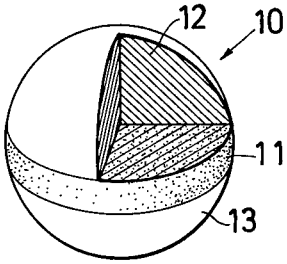

The revolving ball 10 may be given either in the form of an internally cavitious sphere as shown in FIG. 2 or in the form of an internally solid sphere as shown in FIG. 3. Anyway, the pair of halves 12 and 13 are electrically insulated from each other by the intermediate insulator.

Comparing the revolving ball 10 to the globe for the purposes of simplification, the upper half 12 of the ball 10 in FIG. 1 will hereinafter be called as the "northern hemisphere", the lower half 13 of the ball 10 in FIG. 1 as the "southern hemisphere", the intermediate insulator 11 as the "insulating tropics" and the axis P of the operating handle 14 as the "earth's axis".

The first electric circuit 20 includes a pair of contacts 21 and 22 which are in axial alignment to each other and in contact with the insulating tropics 11 of the ball 10 when the earth's axis P extends in the vertical direction. The pair of contacts 21 and 22 are electrically coupled to a load 23 such as a DC. motor.

Thus, the circuit 20 will hereinafter be referred to as the "first load circuit".

The second electric circuit 30 includes a pair of contacts 31 and 32 which are in axial alignment to each other and in contact with the insulating tropics 11 when the earth's axis P extends in the vertical direction. Thus, the contacts 31 and 32 of the circuit 30 and the contacts 21 and 22 of the load circuit 20 are substantially in a common horizontal plane, i.e. an X–Z plane. The pair of contacts 31 and 32 are electrically coupled to a load 33 such as a DC. motor. Thus, the circuit 30 will hereinafter referred to as the "second load circuit".

The third electric circuit 40 includes a pair of contacts 41 and 42 which are in axial alignment to each other and respectively in contact with the corresponding halves of the ball 10. In the illustrated embodiment, the one contact 41 is in contact with the northern hemisphere 41 whereas the other contact 42 is in contact with the southern hemisphere 13. The contacts 41 and 42 are electrically coupled to opposite electrodes of a given electric power source 43 such as a storage batteries. Thus, the third electric circuit 40 will hereinafter be referred to as the "driving circuit".

It should be noted that the contacts 21, 22, 31, 32, 41 and 42 are fixed to their given positions whereas the ball 10 is revolvable in various directions with respect to its center, the latter being immovable with respect to the associated contacts.

The switching operation is carried out as follows on the switching mechanism of the present invention having the above-described basic construction.

Figure 4:
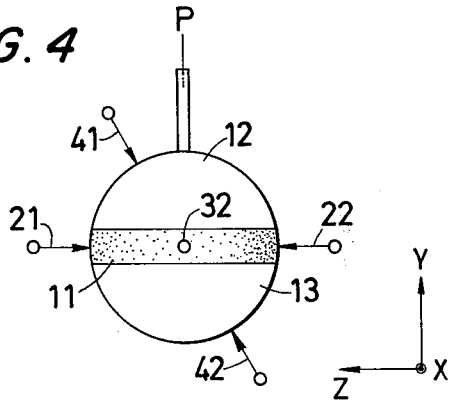

The disposition of the switching mechanism seen in the direction of the X-axis in FIG. 1 is shown in FIG. 4, in which the contacts 21, 22, 31 and 32 are all in contact with the insulating tropics 11, the contact 41 is in contact with the northern hemisphere 12 and the contact 42 is in contact with the southern hemisphere 13. Provided that the contact 41 is coupled to the positive electrode of the power source 43 whereas the contact 42 is coupled to the negative electrode of the power source 43, the northern hemisphere 12 of the ball 10 is charged positively whereas the southern hemisphere 13 of the ball 10 is charged negatively. It will be well understood that no electric current flow through the circuits 20 and 30.

Figure 5:
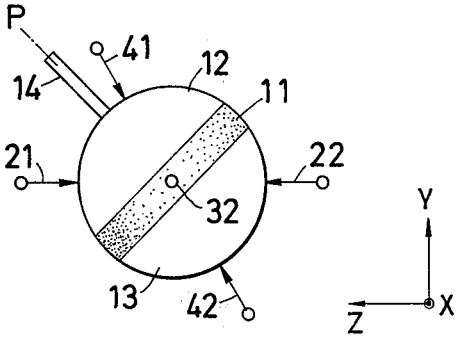

Then, provided that the handle 14 is turned towards the Z-axis (positive area) and the earth's axis P tilts towards the Z-axis (positive area) about 45° as shown in FIG. 5, the contact 21 comes into contact with the positively charged northern hemisphere 12 and the contact 22 comes into contact with the negatively charged southern hemisphere 13. Then, the contact 21 is biased positively, the contact 22 is biased negatively and the electric current flows through the load circuit 20 from the contact 21 to the contact 22. This current flow energizes the load 23. When the load 23 is given in the form of a DC. motor, the motor 23 starts to rotate in one direction, e.g. in the clockwise direction. Meanwhile, the contacts 31 and 32 still remain in contact with the insulating tropics 11 and no current flows through the load circuit 30.

Figure 6:
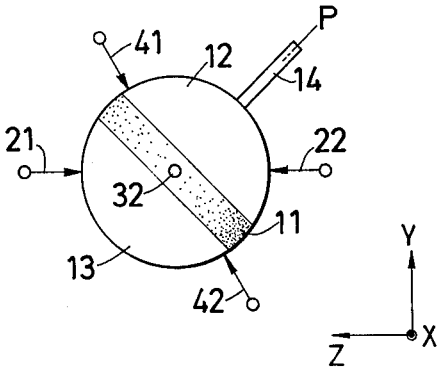

Alternatively, provided that the handle 14 is turned towards the Z-axis (negative area) and the earth's axis P tilts towards the Z-axis (negative area) about 45° as shown in FIG. 6, the contact 21 comes into contact with the negatively charged southern hemisphere 13 and the contact 22 comes into contact with the positively charged northern hemisphere 12. Then, the contact 21 is biased negatively, the contact 22 is biased positively and the electric current flows through the load circuit 20 from the contact 22 to the contact 21. This current flow energizes the load 23 with a polarity opposite to that of the load energization in the disposition shown in FIG. 5. Consequently, when the load 23 is given in the form of the DC. motor, the motor 23 starts to rotate in the other direction, e.g. in the counterclockwise direction. During this procedure, the contacts 31 and 32 still remain in contact with the insulating tropics 11 and no current flows through the load circuit 30.

Figure 7:
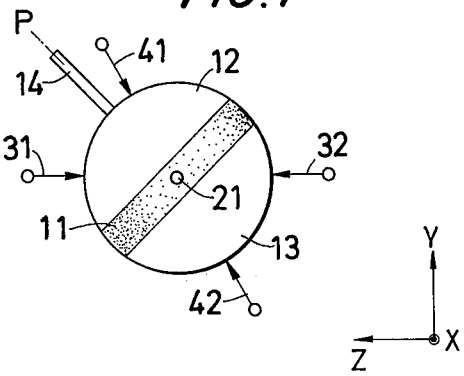

In the same way, by turning the handle 14 within a vertical plane perpendicular to the Z-axis about 45° into two opposite directions, the load circuit 30 can be activated with two different polarities. In this case, the contacts 21 and 22 of the load circuit 20 remain in contact with the insulating tropics 11 and no current flows through the load circuit 20. One of the two dispositions in this sense is shown in FIG. 7, in which the contact 31 is positively biased whereas the contact 32 is negatively biased. In this case, the contacts 21 and 22 of the load circuits 20 remain in contact with the insulating tropics 11 and the load circuit 20 is not activated.

In the foregoing examples, only one of the two load circuits 20 and 30 is selectively activated. It is, however, possible also to activate both load circuits 20 and 30 simultaneously with desired combination of polarities.

Figure 8:
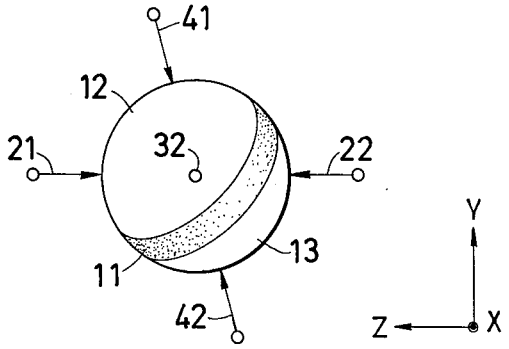

For example, in the disposition shown in FIG. 8, the handle 14 of the ball 10 in the disposition shown in FIG. 5 was turned towards the X-axis (positive area) and the earth's axis P tilts towards the X-axis (positive area) about 45°, the handle being omitted in the illustration for the purposes of simplification. In this disposition, the contacts 21 and 32 come into contact with the positively charged northern hemisphere 12 and are biasd positively. Whereas, the contacts 22 and 31 (not shown) come in contact with the negatively charged southern hemisphere 13 and are biased negatively. Thus the electric current flows from the contact 21 to the contact 22 through the load circuit 20 whereas it flows from the contact 32 to the contact 21 through the load circuit 30.

Figure 9:
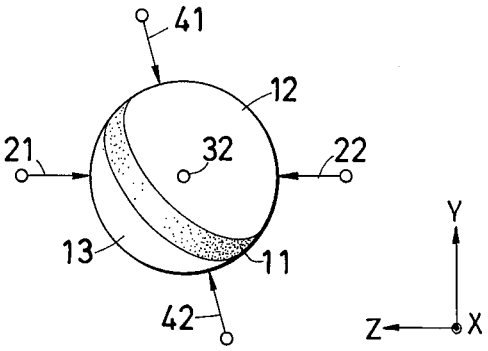

In the disposition shown in FIG. 9, the handle of the ball 10 in the disposition shown in FIG. 6 was turned toward the X-axis (negative area) and the earth's axis P tilts toward the X-axis (negative area) about 45°, the handle 14 being omitted in the illustration for the purposes of simplification. In this disposition, the contacts 21 and 32 come into contact with the negatively charged southern hemisphere 13 and are biased negatively. Whereas, the contacts 22 and 31 (not shown) come into contact with the positively charged northern hemisphere 12 and are biased positively. Thus, the electric current flows from the contact 22 to the contact 21 through the load circuit 20 whereas it flows from the contact 31 to the contact 32 through the load circuit 30. It will be well understood that polarities of load activations in the disposition shown in FIG. 9 is quite opposite to those in the disposition shown in FIG. 8.

Figure 10:
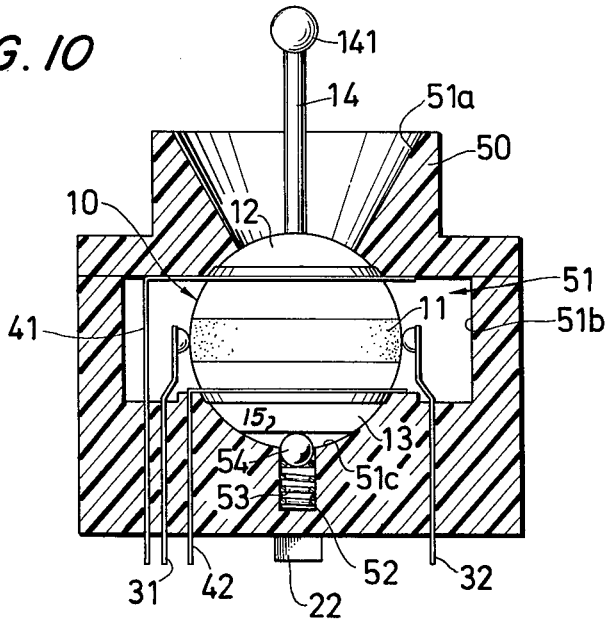
FIG. 10 is a side plan view, partly in section, of an embodiment of the switching mechanism in accordance with the present invention.

A basic embodiment of the multi-directional switching mechanism in accordance with the present invention is shown in FIG. 10, in which a housing 50 is provided with a cavity 51 for accommodating the revolving ball 10. The cavity 51 is comprised of a column shaped intermediate portion **51*b*, a conical portion 51*a* convergingly merging into the intermediate portion 51*b* and a hemispheric portion 51*c* divergedly merging into the intermediate portion 51*b*, the conical portion 51*a* divergedly opening in one end surface of the housing 50**.

The revolving ball 10 is accommodated in the cavity 51 in such an arrangement that a part of the northern hemisphere 12 is exposed in the conical portion **51*a*, a part of the southern hemisphere 13 is seated in the hemispheric portion 51*c* and the remaining part of the ball 10 including the insulating tropics 11 is positioned in the intermediate portion 51*b***. The operating handle 14 extends outwards of the housing 50 through the conical portion 51*a* of the cavity and preferably provided at its free end with a knob 141 for operator's convenience.

The diameter of the intermediate portion 51*b* is larger than that of the ball 10 in order to leave a cylindrical space around the ball 10 for installation of the contacts.

Figure 11:
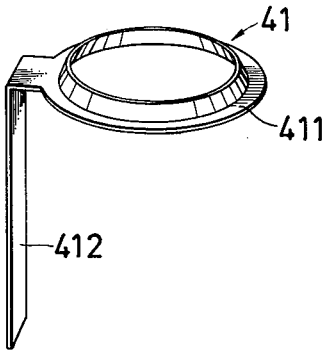
FIGS. 11 and 12 are perspective plan views of the contacts of the load circuits used in the arrangement shown in FIG. 10.
Figure 12:
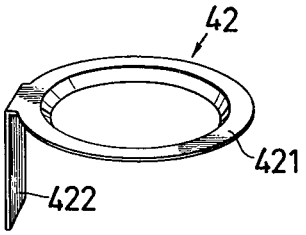

In the case of the illustrated embodiment, the one contact 41 of the driving circuit 40 (see FIG. 1) is given in the form of a body shown in FIG. 11 which is comprised of a ring 411 and a foot 412. The ring 411 is in contact with the outer surface of the norhern hemisphere 12 of the ball 10 and the foot 412 is fixed to and extends out of the housing 50. Likewise, the other contact 42 of the driving circuit 40 is given in the form of a body shown in FIG. 12 which is comprised of a ring 421 and a foot 422. The ring 421 is in contact with the outer surface of the southern hemisphere 13 of the ball 10 and the food 422 is fixed to and extends out of the housing 50. Although not shown in the drawing, the contacts 41 and 42 are coupled to the common power source 43 forming the driving circuit 40. The annular contact of the contacts 41 and 42 of the driving circuit 40 assures constant successful charging of the ball 10 regardless of turning of the latter into any directions.

The one contact 31 of the second load circuit 30 has a foot fixed to and extending out of the housing 50 and a round surface in contact with the outer surface of the ball 10. Likewise, the other contact 32 of the second load circuit 30 has a foot fixed to and extending out of the housing 50 and a round surface in contact with the outer surface of the ball 10. The construction and mounting of the contacts 21 and 22 of the first load circuit 20 are quite the same as those of the above-described contacts 31 and 32. In the illustrated disposition, all the contacts 21, 22, 31 and 32 of the load circuits 20 and 30 are in contact with the insulating tropics 11 and the loads 23 and 33 are not activated. Mounting of the contacts 21, 22, 31 and 32 should preferably be so designed that their terminal round surfaces are kept in a resilient pressure contact with the outer surface of the ball 10. Provision of the round surfaces assures a smooth turning of the ball 10 despite of such a pressure contact of the load circuit contacts 21, 22, 31 and 32 with the ball 10.

In the case of the illustrated embodiment, the revolving ball 10 is provided on the side thereof opposite to the handle 14 with a flat surface 15. In correspondence with this, a hole 52 is formed in the housing 50 in alignment with the axis of the intermediate portion 51*b* of the cavity 51, in which a compression spring 53 is inserted. A small ball 54 is pressed against the flat surface 15 of the revolving ball 10 by the spring 53.

In operation, switching of the circuits 20 and 30 is carried out as desired by press tilting the handle 14 in a suitable direction. As the force applied on the handle 14 by hand is removed, the ball 10 quite automatically resumes its neutral disposition, in which all the load circuit contacts 21, 22, 31 and 32 are in contact with the insulating tropics 11 of the ball 10 as shown in FIG. 10, due to the repulsion of the spring 53. In case it is desired to keep the tilted disposition of the handle 14 for a long period, the spring 53 may be removed.

As is clear from the foregoing explanation, the present invention provides a very compact switching mechanism of a simple construction by which switching a plurality of load circuits can be carried out quite freely through a simple operation of the handle.

What is claimed is:

1. A multi-directional switching mechanism comprising, in combination, a housing having an internal cavity, a revolving ball accommodated in said cavity of said housing in such an arrangement as being able to turn in any selected direction about the center thereof and comprised of a pair of electro-conductive hemispheres and an electro-insulating intermediate portion sandwiched by said pair of hemispheres, an operating handle extending radially from the outer surface of said revolving ball out of said housing by way of which said ball is manually turned in multiple directions, a driving circuit having a pair of terminals disposed to said housing one of which is in a constant contact with one of said hemispheres of said ball and the other of which is in a constant contact with the other of said hemispheres and at least a load circuit having a pair of terminals disposed to said housing in such an arrangement that points of contact of said terminals with said ball are symmetric to each other with respect to said center of said ball.

2. A multi-directional switching mechanism as claimed in claim 1 in which two or more load circuits are provided and points of contact of terminals of at least two load circuits are in a common plane including said center of said ball.

3. A multi-directional switching mechanism as claimed in claim 1 in which the axial direction of said operating handle crosses border planes of said intermediate portion with said hemispheres at a right angle.

4. A multi-directional switching mechanism as claimed in claim 1 in which said cavity includes a columnshaped intermediate portion the inner diameter of which is larger than the largest diameter of said revolving ball, a conical portion divergedly opening in the outer surface of said housing and convergingly merging into said intermediate through which said operating handle extends outwards and a hemispheric portion divergely merging into said intermediate portion on the side opposite to said conical portion.

5. A multi-directional switching mechanism as claimed in claim 4 in which said terminals of said driving and load circuits are in contact with said revolving ball within said intermediate portion of said cavity.

6. A multi-directional switching mechanism as claimed in claim 1 in which said one terminal of said driving circuit includes a ring in an annular contact with said one hemisphere of said ball and a foot integral of said ring and fixed to said housing.

7. A multi-directional switching mechanism as claimed in claim 1 in which said other terminal of said driving circuit includes a ring in an annular contact with said other hemisphere of said ball and a foot integral of said ring and fixed to said housing.

8. A multi-directional switching mechanism as claimed in claim 1 in which said ball is given in the form of a solid sphere.

9. A multi-directional switching mechanism as claimed in claim 1 in which said ball is given in the form of an internally cavitious sphere.

10. A multi-directional switching mechanism as claimed in claim 1 further comprising means for automatically returning said revolving ball, after turning into a selecter direction, to the initial neutral disposition in which said terminals of said load circuit are all in contact with said electro-insulating intermediate portion of said revolving ball.

11. A multi-directional switching mechanism as claimed in claim 10 in which said returning means includes a flat surface formed on said revolving ball on the opposite side of said operating handle, a small ball in contact with said flat surface portion within said cavity of said housing and means for resiliently urging said small ball into a pressure contact with said flat surface portion of said revolving ball.

12. A multi-directional switching mechanism as claimed in claim 11 in which said resilient urging means includes a compression spring inserted into a hole formed in said cavity in axial alignment with said operating handle.

13. A multi-directional switching mechanism as claimed in claim 1 in which said terminals of said load circuit are provided at their ends in contact with said ball with round surfaces.

* * * * *